US005123434A

United States Patent [19]

Fetterly

[11] Patent Number: 5,123,434

[45] Date of Patent: Jun. 23, 1992

[54] INDIVIDUAL PROTECTIVE CANOPY

[76] Inventor: Daniel R. Fetterly, 6481 San Marco Cir., Los Angeles, Calif. 90068

[21] Appl. No.: 686,522

[22] Filed: Apr. 17, 1991

[51] Int. Cl.[5] ..... A45B 11/00

[52] U.S. Cl. ..... 135/20.2; 52/2.22

[58] Field of Search ..... 52/2.22, 2.24, 2.18; 135/20.2

[56] References Cited

U.S. PATENT DOCUMENTS

| | | | |
|---|---|---|---|
| 2,684,483 | 7/1954 | Kwake | 135/20.2 X |
| 2,827,909 | 3/1958 | Platzke | 135/20.2 |
| 3,278,938 | 10/1966 | Rosenthal | 52/2.22 X |
| 3,606,719 | 9/1971 | Berry | 52/2.22 X |
| 3,802,451 | 4/1974 | Morris | 52/2.18 X |
| 4,556,391 | 12/1985 | Tardivel et al. | 52/2.24 X |
| 4,643,210 | 2/1987 | Feld | 135/20.2 |
| 5,007,212 | 4/1991 | Fritts et al. | 52/2.18 |

FOREIGN PATENT DOCUMENTS

| | | | |
|---|---|---|---|
| 0545219 | 3/1958 | Italy | 52/2.22 |
| 0651197 | 1/1963 | Italy | 135/20.2 |
| 0925673 | 5/1963 | United Kingdom | 52/2.18 |

*Primary Examiner*—David A. Scherbel
*Assistant Examiner*—Lan Mai
*Attorney, Agent, or Firm*—Lyon & Lyon

[57] ABSTRACT

A protection canopy for an individual including a non-porous sheet, an inflatable tube about the periphery of the sheet and extending diametrically of the sheet and a compressed gas cartridge. The sheet is attached centrally to a pack and may be folded into that pack for ready use. The pack may be attached to the upper back portion of an individual in preparation for deployment. A lanyard is attached to a breakable closure and to the compressed gas cartridge such that one pull will open the pack and release compressed gas into the inflatable element.

6 Claims, 2 Drawing Sheets

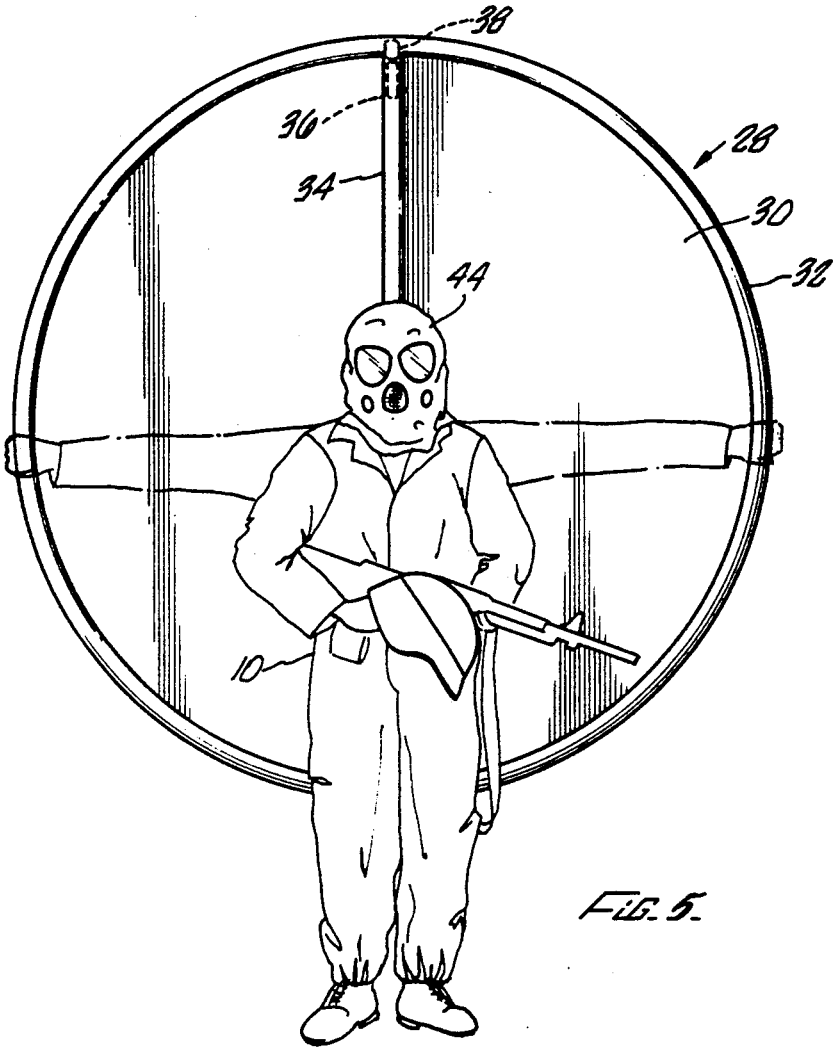
FIG. 5.
FIG. 6.
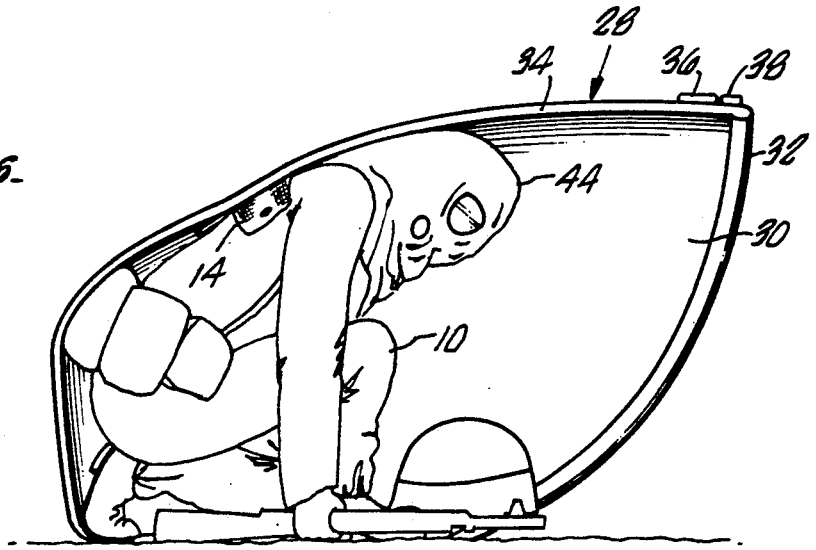

INDIVIDUAL PROTECTIVE CANOPY

BACKGROUND OF THE INVENTION

The field of the present invention is protective equipment against airborne chemical agents. As early as July 1970, the Department of the Army stated in "Nuclear, Biological and Chemical", Subcourse INO 314, Edition 9, that "U.S. Forces must be organized, trained and equipped to survive and operate effectively in a chemical environment." A variety of countries, including third world nations as well as superpowers, are known to have chemical weapons. To date it is understood that the protection available to individual soldiers requires several minutes to don. During the time required to put on such equipment, the individual is sufficiently exposed to receive a casualty producing dose of chemical agent. Instead, preparation in a matter of seconds is required for appropriate protection. Consequently, a need exists for rapidly deployable individual protection against chemical agents.

SUMMARY OF THE INVENTION

The present invention is directed to a protective canopy for individuals which can be deployed within a matter of seconds. A nonporous sheet including an inflatable element about the periphery thereof in association with a compressed gas cartridge provides rapidly deployable protection. The canopy device may be attached on the upper back of an individual for rapid deployment.

In one aspect of the present invention, an attachment is centrally located to cooperate with a holder that may be located on the upper back of the individual. Upon deployment, a semirigid structure is created which is attached to the upper back. The soldier may wrap the device about himself, facing away from the source of the chemical agent to receive shelter therefrom.

In another aspect of the present invention the device is folded within a compact pack requiring the single pull of a lanyard to open the pack and release the compressed gas into the inflatable element.

In a further aspect of the present invention, the structure is devised with the inflatable element at a comfortable arms length reach such that the canopy might be pulled quickly down about a crouching individual. By pulling the canopy down on either side and stepping on the lowermost part of the canopy, an individual in a crouching position can be effectively covered on three sides. By facing away from an airborne deployment or the like, exposure is minimized or eliminated.

Accordingly, it is an object of the present invention to provide rapidly deployable individual protection against airborne deployed chemical agents. Other and further objects and advantages will appear hereinafter.

BRIEF DESCRIPTION OF THE DRAWINGS

FIG. 5 is a front view of a soldier with a deployed device of the present invention mounted thereon.

FIG. 6 is a side view partially in section illustrating a soldier in the protective position with a device of the present invention.

DETAILED DESCRIPTION OF THE PREFERRED EMBODIMENT

Figure 1:
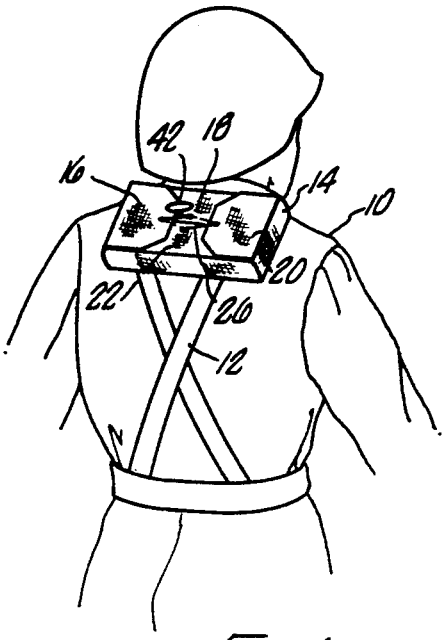
FIG. 1 is a perspective view of a soldier wearing a packed device present invention.

Turning in detail to the drawings, an individual protective canopy is illustrated in its packed condition on the back of a soldier 10. The soldier 10 includes a load-carrying equipment harness 12 to which a pack 14 is attached. The pack 14 forms a holder locatable on the upper back portion of the soldier as seen in FIG. 1. Hook-pile tape fastener, or "Velcro", may be used to attach the pack 14 to the load carrying equipment harness 12.

Figure 4:
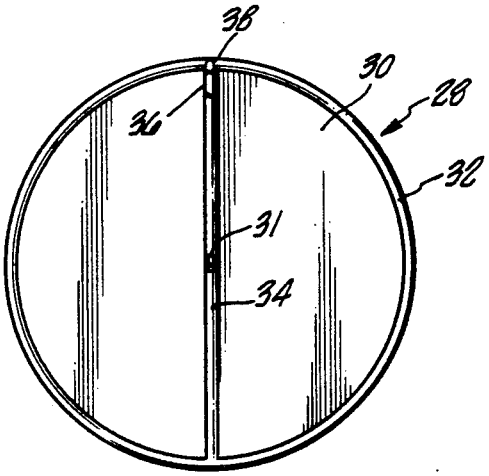
FIG. 4 is a plan view of a deployed device of the present invention.
Figure 3:
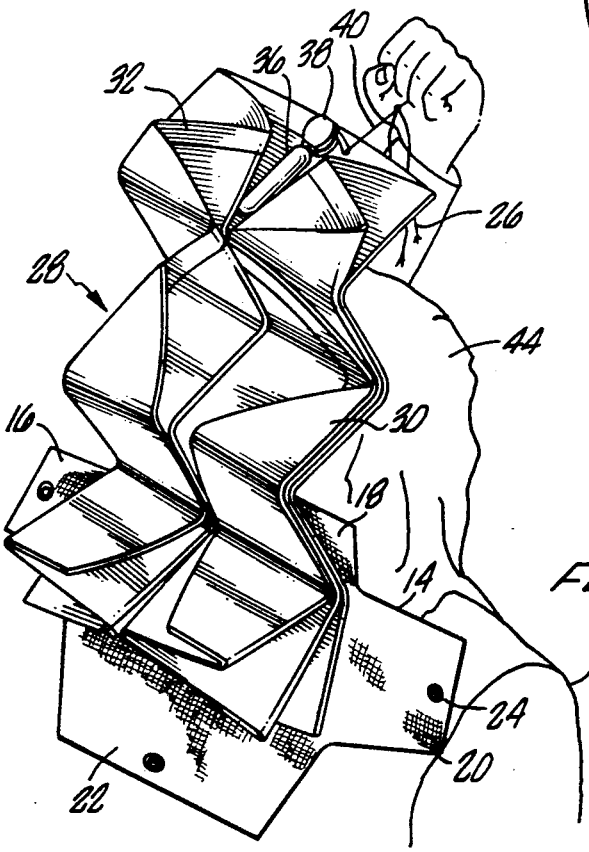
FIG. 3 is a perspective view of a soldier deploying the device of the present invention.

The pack 14 is constructed as best seen in FIGS. 3 and 4 to include a base (hidden) to which four flaps 16, 18, 20 and 22 are attached. The flaps 16, 18, 20 and 22 include grommets 24 positioned such that when the flaps 16, 18, 20 and 22 are closed, they are collected in a small area such that a single loop of 40-pound pack tie cord 26 may be threaded to provide a breakable closure.

The canopy itself is illustrated in the opened position in FIGS. 4 and 5. The canopy, generally designated 28, includes a circular rubberized rip-stop nylon cloth 30 which is preferably camouflaged. The diameter of the canopy is preferably approximately 82 inches to be a comfortable reach to either side at arms length by reaching somewhat upwardly or downwardly to grip the diameter. The canopy 28 is attached by means of a permanent fastener 31 to the pack 14.

The nonporous sheet is made semirigid by a circular inflatable element 32. The inflatable element 32 may be formed through a roll of the rubberized sheet or may be separately constituted. Extending diametrically is a second inflatable element 34 which is in communication with the element 32 in order that they may be filled simultaneously. In communication with the elements 32 and 34 is a CO2 cartridge 36 having a valve 38. The nonporous sheet may be coated with decontaminating/neutralizing powder.

Figure 2:
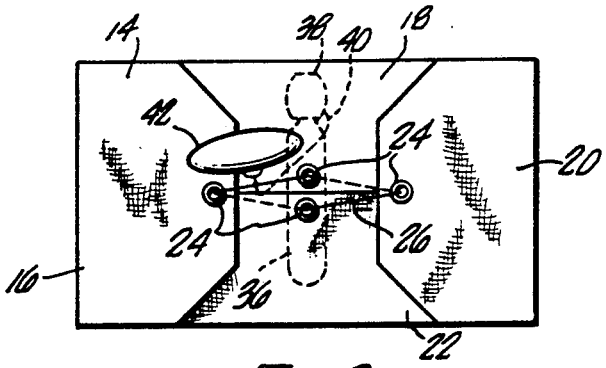
FIG. 2 is a plan view of the device of the present invention in it packed condition.

A lanyard 40 is attached to the valve as can best be seen in FIGS. 2 and 3. The lanyard 40 includes a pull ball 42 which can be easily gripped by the user. The lanyard 40 is tied to the tie cord 26 such that actuation through pulling of the pull ball 42 breaks the tie cord 26 to open the pack 14 and actuates the valve 38 to inflate the inflatable elements 32 and 34.

As can be seen in FIG. 3, the overall device including the nonporous sheet is folded with accordion pleats such that it will easily open and inflate without manual assistance. The sheet is folded with accordion pleats on the lower half of the canopy with those accordion pleats being horizontal. Once this is done, vertical accordion pleats contract the sides into the width of a pack. Finally, horizontal folds fold the top half down into pack size.

To deploy, the individual will reach back to the pull ball 42 and pull forward over his head. This motion will break the tie cord 26 and activate the valve 38. This will also start to unfold the canopy as air is deployed into the inflatable elements 32 and 34. Once fully inflated, the semirigid canopy 28 may be grasped around the periphery. The individual would bend down until he could put one foot on the periphery of the canopy directly behind him. He would then draw the two sides down to the ground to either side such that a shelter is generated as illustrated in FIG. 6. Naturally, other protective gear is advantageously used such as the mask 44.

The protective canopy is useful beyond the protection of an individual. It is large enough such that personal equipment might be retained within the canopy to also remain uncontaminated. Medics could cover both themselves and an injured individual. Evacuation can also be assisted by use of the canopy during landings of wind-generating helicopters which would stir up chemical agent. The canopy could also be used in dust storms and as camouflage when not deployed against chemical agents.

Thus, an improved protection device against chemical agents for the individual including a readily deployable canopy is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An individual protective canopy comprising
a nonporous sheet;
an inflatable element about the periphery of said sheet;
a compressed gas cartridge in selective communication with said inflatable element;
an attachment centrally located on said sheet;
a holder locatable on the upper back of an individual constructed and arranged for retention of said attachment, said holder including a pack for receipt of said nonporous sheet and said inflatable element with said nonporous sheet folded, said pack including a lanyard extending to said pack and to said compressed gas cartridge to open said pack and activate said gas cartridge with a single pull.

2. The canopy of claim 1 further comprising a diametrically disposed inflatable element extending across said sheet to said inflatable element at opposed locations about the periphery of said sheet and being in communication with said inflatable element.

3. The canopy of claim 2 wherein said inflatable element is displaced outwardly from said attachment a distance such that an individual to whom said sheet is attached can comfortably reach said inflatable element to either side at arms length, said diametrically disposed inflatable element extending in the same direction as the body length of the individual.

4. The canopy of claim 1 wherein said nonporous sheet is rubberized rib-stop nylon cloth.

5. The canopy of claim 4 wherein said nonporous sheet is coated with decontaminating/neutralizing powder.

6. An individual protective canopy comprising
a nonporous sheet;
an inflatable element about the periphery of said sheet;
a compressed gas cartridge in selective communication with said inflatable element;
an attachment centrally located on said sheet;
a holder locatable on the upper back of an individual constructed and arranged for retention of said attachment, said holder including a pack for receipt of said nonporous sheet and said inflatable element with said nonporous sheet folded, said pack including a breakable closure and a lanyard, said lanyard extending to engage said breakable closure and said compressed gas cartridge to break said breakable closure and activate said gas cartridge with a single pull.

* * * * *